US008197320B2

(12) United States Patent
Corriveau

(10) Patent No.: US 8,197,320 B2
(45) Date of Patent: Jun. 12, 2012

(54) TABLE GAME RELATED BROADCAST SHOW AND LOTTERY

(76) Inventor: Sylvain Corriveau, Ste-Therese (CA)

( * ) Notice: Subject to any disclaimer, the term of this patent is extended or adjusted under 35 U.S.C. 154(b) by 582 days.

(21) Appl. No.: 12/359,098

(22) Filed: Jan. 23, 2009

(65) Prior Publication Data

US 2009/0186677 A1 Jul. 23, 2009

Related U.S. Application Data

(60) Provisional application No. 61/006,598, filed on Jan. 23, 2008.

(51) Int. Cl.
*A63F 9/24* (2006.01)

(52) U.S. Cl. ..... 463/13

(58) Field of Classification Search ..... 463/13
See application file for complete search history.

(56) References Cited

U.S. PATENT DOCUMENTS

2008/0315525 A1* 12/2008 Hoyt et al. ..... 273/292

* cited by examiner

*Primary Examiner* — William D Coleman

(57) ABSTRACT

A method for providing a poker-related game related broadcast show, comprising selecting players, providing each player with a medal indicative of a gaming position order, positioning the players at respective gaming surfaces according to the order associated with the medal provided at step, playing hands of the poker-related game until at least one player is eliminated, handing over the medal of the at least one eliminated player to a winning player and eliminating prizes in accordance with random selections made by the eliminated at least one eliminated player until only one player remains, the remaining player being identified as the grand winner, allowing the grand winner to bring back into play an eliminated prize for each medal possessed by the grand winner and allowing the grand winner to randomly select a prize.

22 Claims, 6 Drawing Sheets

TABLE GAME RELATED BROADCAST SHOW AND LOTTERY

CROSS-REFERENCE

This application claims the benefits of U.S. provisional patent applications No. 61/006,598 filed Jan. 23, 2008; which is hereby incorporated by reference.

TECHNICAL FIELD

The present invention relates to a table game related broadcast show and lottery.

BACKGROUND

Game shows have always been present since the beginnings of television broadcasting. With ever increasing competition, producers try to come up with new concepts so has to capture a bigger share of viewers.

However, most concepts do not involve the viewer. Thus, there is a need for an innovative game show concept that involves the viewer so as to increase viewer loyalty.

SUMMARY

According to the present invention, there is provided a method for providing a poker-related game related broadcast show, comprising:

a) selecting players;

b) providing each player with a medal indicative of a gaming position order;

c) positioning the players at respective gaming surfaces according to the order associated with the medal provided at step b);

d) playing hands of the poker-related game until at least one player is eliminated;

e) handing over the medal of the at least one eliminated player to a winning player;

f) eliminating prizes in accordance with random selections made by the eliminated at least one eliminated player;

g) repeating steps e) and f) until only one player remains, the remaining player being identified as the grand winner; and h) allowing the grand winner to bring back into play an eliminated prize for each medal possessed by the grand winner; and i) allowing the grand winner to randomly select a prize.

According to the present invention, there is also provided a method of conducting a table game related broadcast show based lottery, comprising:

a) providing lottery tickets having thereon at least one series of symbols, each symbol being associated with a players of the table game related broadcast show;

b) conducting the table game related broadcast show;

c) producing a wining series of symbols from the order in which the players are eliminated during the table game related broadcast show and the grand winner; and d) attributing prizes to the lottery tickets in accordance with a number of correct symbols in the at least one series of symbols thereon.

BRIEF DESCRIPTION OF THE FIGURES

Embodiments of the invention will be described by way of example only with reference to the accompanying drawings, in which.

DETAILED DESCRIPTION

Generally stated, the non-limitative illustrative embodiment of the present invention provides a table game related broadcast show and lottery based on Texas Hold'Em poker.

Broadcast Show

Figure 1A:
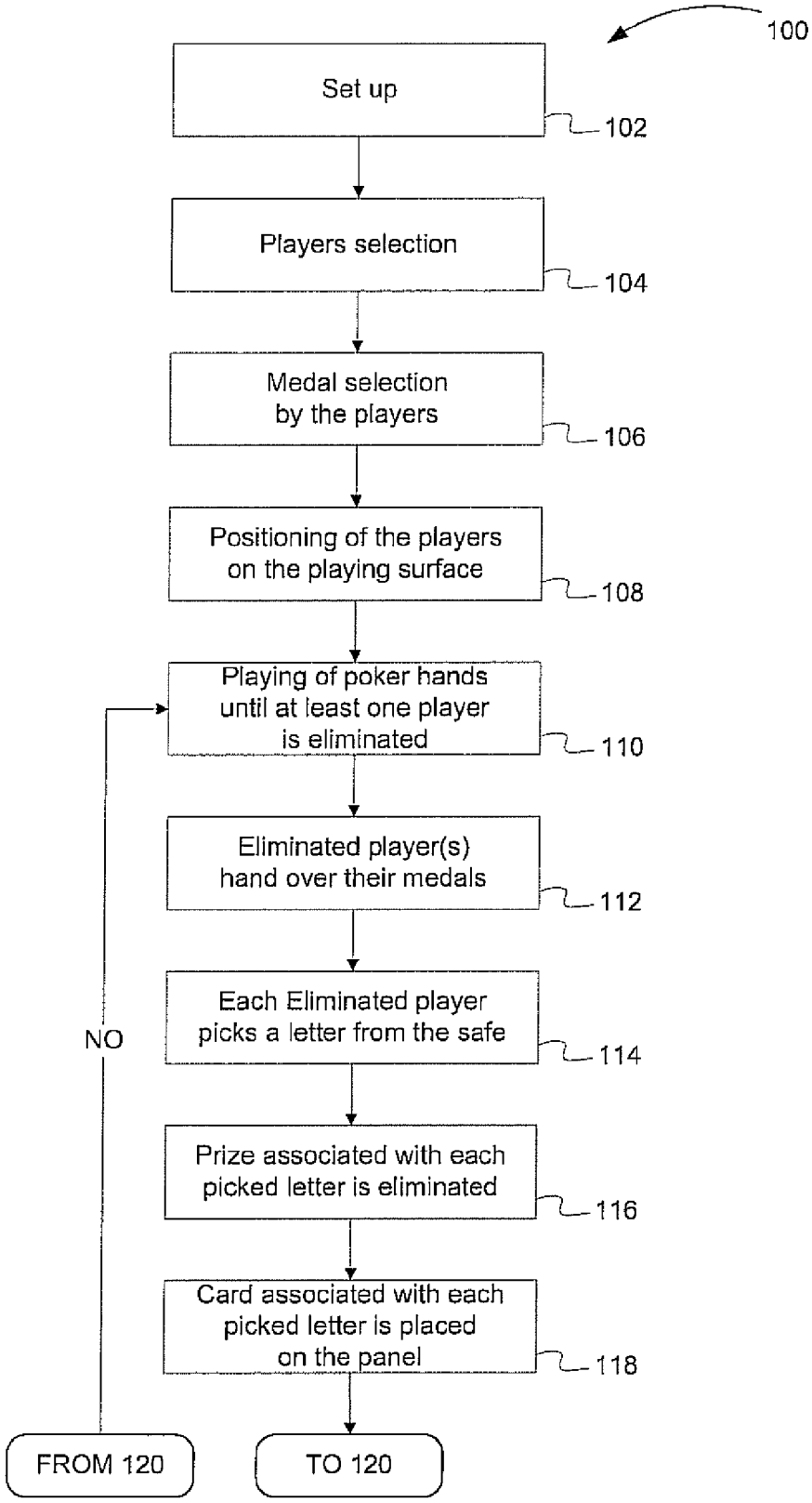
FIGS. 1*a*, 1*b* and 1*c* is a flow diagram depicting an illustrative example of a procedure representing the course of the table game related broadcast show based on Texas Hold'Em poker.
Figure 1B:
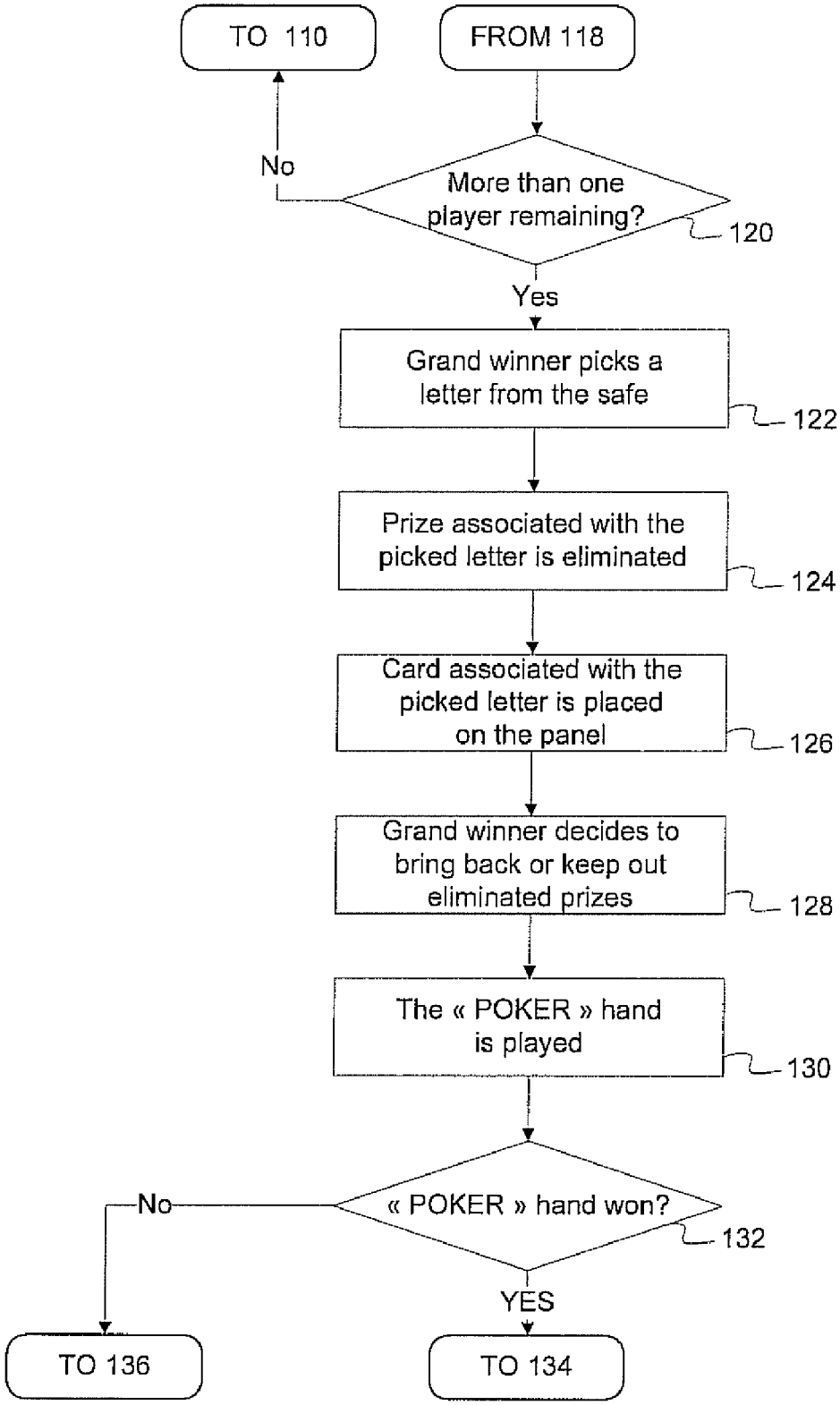
Figure 1C:
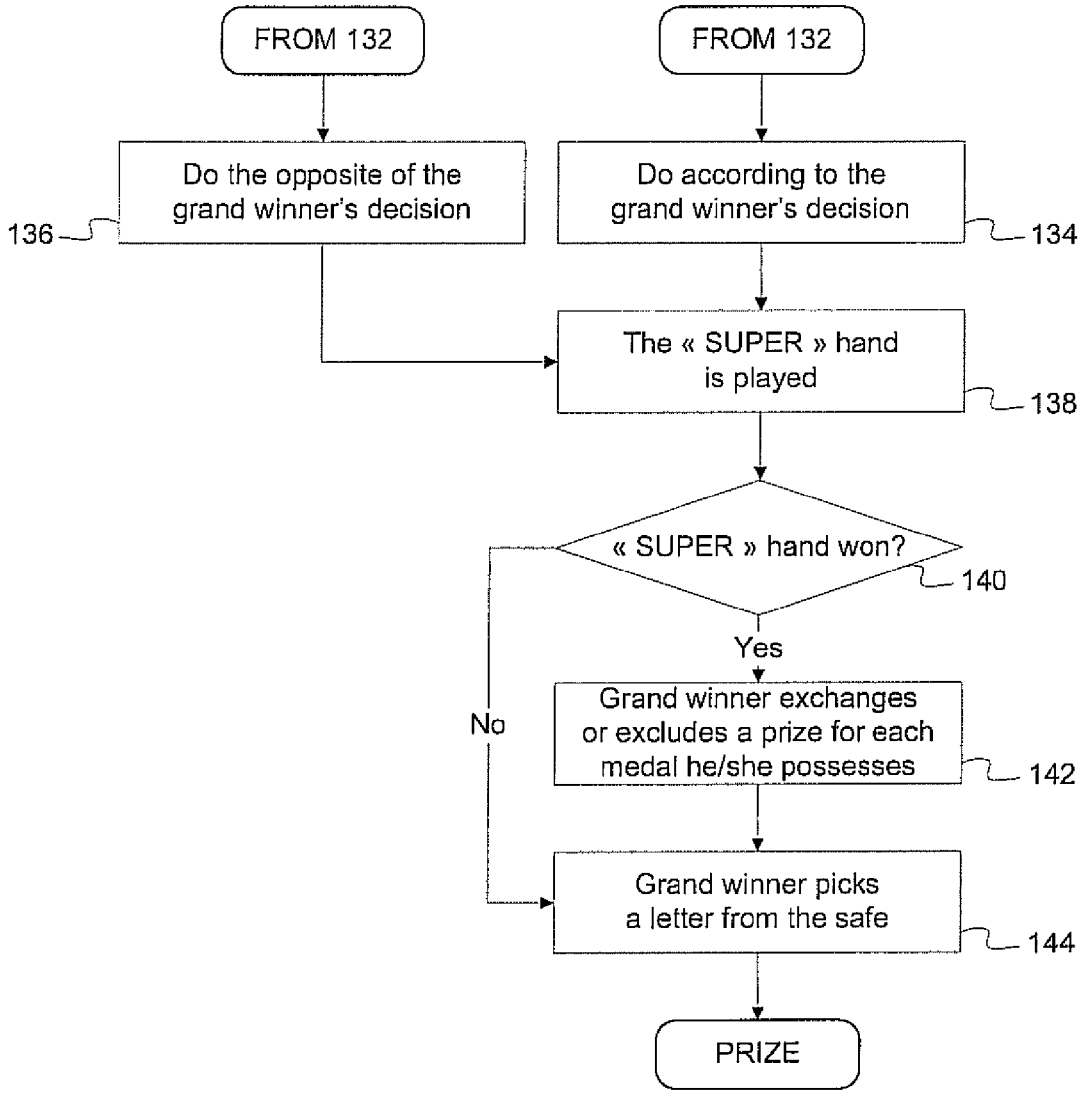

Referring to FIGS. 1*a*, 1*b* and 1*c*, there is shown a flow diagram of an illustrative example of a procedure 100 representing the course of a table game related broadcast show based on Texas Hold'Em poker. The steps of the procedure 100 are indicated by blocks 102 to 144.

In the following description of procedure 100, references will be made to FIG. 2, which shows a schematic view of an illustrative example of a set 200 which may be used in conjunction with the procedure 100 of FIGS. 1*a*, 1*b* and 1*c*.

The set 200 includes:

players 1, 2, 3, 4, 5, 6, 7, 8, 9 and 10;

a master of ceremonies 202, which is responsible for the game show following its intended course and interacting with the players 1, 2, 3, 4, 5, 6, 7, 8, 9 and 10, such as interviewing them during the game and/or as they are eliminated;

10 cases 203, each containing a medal with a letter inscribed thereon, seven letters (S, U, P, E, R, O, K) of a first color, for example red, and three letters (P, E, R) of a second color, for example blue;

a hostess 204, which assist the master of ceremonies;

a safe box 205 containing 26 chips with the letters A to Z inscribed thereon, the seven letters "S", "U", "P", "E", "R", "O" and "K" (these letters spell "SUPER OK" and are the unique letters from the term "SUPER POKER") inscribed in the first color, e.g. red, and being designated as "super letters", the remaining 19 letters being inscribed in the second color, e.g. blue and being designated as regular letters;

one or more cameraman 206 with an associated video camera 207;

a tournament director 208, which is responsible for enforcing the rules of the game;

a dealer 210;

an audience 220;

a display panel 300 having a prize section 302, a card section 304 with a "SUPER" and a "POKER" sub-sections 304*a* and 304*b*, respectively, and a probability section 306; and a gaming table 400 including gaming surfaces 410 for each of the players 1, 2, 3, 4, 5, 6, 7, 8, 9 and 10, the gaming table 400 may have therein cameras, lighting, sound, electronic displays, etc.

All of the above elements will be further detailed as the procedure 100 is described.

It is to be understood that the appearance of the set 200 and the number of players and/or cast may be different than illustrated. It is also to be understood that some elements may be added or omitted. For example, the set 200 may or may not include an audience 220, other displays may be added and the safe box 205 may be replaced by a vase or other opaque container.

Furthermore, in an alternative embodiment, the gaming table 400 may include a betting surface 410 and a playing surface 420 on two different levels, the playing surface being positioned lower than the betting surface 410, at the center of the gaming table 400. The betting surface 410 being used to receive the gaming chips while the playing surface 420 is used to display the hands of each player 1, 2, 3, 4, 5, 6, 7, 8, 9 and 10 (either through an electronic display or by displaying the actual cards).

In its alternative embodiment, the dimensions of the gaming table 400, and in particular the height difference between the betting surface 410 and the playing surface 420, should be such as to allow the audience 220 to see the hands of each player 1, 2, 3, 4, 5, 6, 7, 8, 9 and 10 while preventing the players themselves from seeing each other's hands. Each player 1, 2, 3, 4, 5, 6, 7, 8, 9 and 10 may have an electronic display or a stand to hold physical cards in order to see their respective hands.

Referring back to FIG. 1, the procedure 100 starts at block 102 where the broadcast show is set up. This includes the identification of the prizes on the prize section 302 of the display panel 300 (either electronically, manually, etc., depending on the type of panel used) and the random assignment of a letter and card with each prize. The chips with the 19 regular and 7 super letters inscribed thereon are placed into the safe box 205. Gaming chips may be placed at each of the players 1, 2, 3, 4, 5, 6, 7, 8, 9 and 10 position around the gaming table 400, for example in the amount of 100,000 (although other numbers of gaming chips may be used). The audience 220 takes its place, the one or more cameraman 206 with their associated video camera 207, as well as the other personnel 202, 204, 208 and 210, take their positions. Any other actions required in order for the show to proceed, such as lighting, television broadcast, etc., may be initiated at this time.

At block 104, the players are selected. For the sake of clarity and conciseness, the procedure 100 will be described, as previously mentioned, using 10 players 1, 2, 3, 4, 5, 6, 7, 8, 9 and 10. However, it is to be understood that a different number of players may be used as well, in which case the gaming table 400 would have a number of gaming surfaces 410 equivalent to the number of players. The players may be selected in various ways. For example, the players 1, 2, 3, 4, 5, 6, 7, 8, 9 and 10 may be selected randomly, winners of a lottery or draw, selected after an interview, celebrities, reality TV contestants, from a studio or casino audience or winners of a tournament. It is to be understood that the players may also be selected previous to the broadcasting of the show, in which case this step may simply be the presentation of the players 1, 2, 3, 4, 5, 6, 7, 8, 9 and 10.

At block 106, the players 1, 2, 3, 4, 5, 6, 7, 8, 9 and 10 selected (or presented) at block 104, each select one of the cases 203 and reveal which medal is contained therein.

Then, at block 108, the players 1, 2, 3, 4, 5, 6, 7, 8, 9 and 10 are positioned at the playing table 400 at respective gaming surfaces 410 according to the medals contained in the case 203 they have selected at block 106. It is to be noted that the letters "P", "E" and "R" are inscribed on two medals each, accordingly the red ones correspond to players 3, 4 and 5, respectively, while the blue ones correspond to players 6, 9 and 10, respectively.

At block 110, poker-related game hands are played until at least one of the players 1, 2, 3, 4, 5, 6, 7, 8, 9 and 10 is eliminated. In the illustrative embodiment, the poker-related game follows the Texas Hold'Em rules, which rules are described further below. However, as a broadcast show is commonly bound by time constrains, the first and second blinds may be increased at given time intervals, each round, when a player is eliminated, etc. For example, in the case where each player has 100,000 chips, the first and second blinds may start at 500 and 1,000 chips, respectively, and increased by 500 and 1,000 chips, respectively, each round. It is to be understood that in alternative embodiments, other poker-related games may be used.

At block 112, the player(s) eliminated at block 110 hand over their medal to the winning player of the hand. However, the eliminated player(s) only hand over the medal they picked at block 106, any other medals won during the game are handed over to the master of ceremonies 202.

At block 114, each of the eliminated player(s) from block 110 picks a letter from the safe box 205 and the prize associated with the picked letter is highlighted in the prize section 302 of the display panel 300, indicating that this prize is to be eliminated. For example, assumed letter "J" has been picked, then the letter "J" and corresponding prize 303 (e.g. the sailboat worth $50,000) are highlighted. If the letter is a "super letter" (e.g. a red letter), then the eliminated player has the option of picking another letter instead, resulting in the prize remaining in the game (the highlight is taken off) and the prize associated with the newly picked letter being highlighted in the prize section 302 of the display panel 300.

At block 116, the prize highlighted in the prize section 302 of the display panel 300 is eliminated from play.

Then, at block 118, the envelope containing a card associated with the eliminated prize at block 116 is placed, for example by the hostess 204, on the card section 304 of the display panel 300 in the space corresponding to the letter inscribed on the eliminated player's medal.

At block 120, if there remains more than one player, then the procedure 100 goes back to block 110 where another round of poker hands is played until at least one player is eliminated. If there remains only one player, then the procedure 110 proceeds to block 122 where the grand winner, e.g. the last remaining player, picks a letter from the safe box 205 and the prize associated with the picked letter is highlighted in the prize section 302 of the display panel 300 indicating that this prize is to be eliminated. If the letter is a "super letter" (e.g. a red letter), then the grand winner has the option of picking another letter instead, resulting in the prize remaining in the game (the highlight is taken off) and the prize associated with the newly picked letter being highlighted in the prize section 302 of the display panel 300.

At block 124, the prize highlighted in the prize section 302 of the display panel 300 is eliminated from play.

Then, at block 126, the envelope containing a card associated with the eliminated prize at block 124 is placed, for example by the hostess 204, on the card section 304 of the display panel 300 in the space corresponding to the letter inscribed on the grand winner's medal.

At block 128, the grand winner has the option to bring back the eliminated prizes, e.g. the prizes that are highlighted in the prize section 302 of the display panel 300, or to keep them out of play.

At block 130, the "POKER" hand is played. Amongst the remaining 26 cards, the dealer 210 deals two cards to the grand winner and two cards to the House, which may be represented, for example, by the master of ceremonies 202. The probabilities of having a winning hand for the grand winner and the House may then be displayed in the probability section 306 of the display panel 300. The "flop" is played by turning the first three cards of the POKER sub-section 304*b* of the card section 304 of the display panel 300, e.g. in positions "P", "O" and "K", after which the probability section 306 is updated. The "turn" is then played, the fourth card of the POKER sub-section 304*b* is turned, i.e. "E", after which the probability section 306 is updated. Finally, the "river" is then played, the fifth card of the POKER sub-section 304*b* is turned, i.e. "R", and the winner is discovered. Should the hand of the grand winner and the House be equal, additional cards may be dealt, for example two, to determine the winner. Alternatively, the House may concede victory to the grand winner as the master of ceremonies 202 has failed to beat the grand winner.

Then, at block 132, if the winner of the "POKER" hand is the grand winner, the procedure 100 proceeds to block 134, if not, the procedure 100 proceeds to block 136.

At block 134, the eliminated prizes are either brought back (e.g. the corresponding letters are put back into the safe box 205) or kept out of play, depending on the decision that the grand winner took at block 128, while at block 136, eliminated prizes are either brought back (e.g. the corresponding letters are put back into the safe box 205) or kept out of play, contrary to the decision that the grand winner took at block 128. In either case, the procedure 100 then proceeds to block 138.

At block 138, the "SUPER" hand is played. Amongst the remaining 31 cards (e.g. the initial 26 cards plus the five cards from the "POKER" hand), the dealer 210 deals two cards the grand winner and two cards to the House, which may be represented, for example, by the master of ceremonies 202. The probabilities of having a winning hand for the grand winner and the House may then be displayed in the probability section 306 of the display panel 300. The "flop" is played by turning the first three cards of the SUPER sub-section 304*a* of the card section 304 of the display panel 300, e.g. in positions "S", "U" and "P", after which the probability section 306 is updated. The "turn" is then played, the fourth card of the SUPER sub-section 304*a* is turned, i.e. "E", after which the probability section 306 is updated. Finally, the "river" is then played, the fifth card of the POKER sub-section 304*a* is turned, i.e. "R", and the winner is discovered. Should the hand of the grand winner and the House be equal, additional cards may be dealt, for example two, to determine the winner. Alternatively, the House may concede victory to the grand winner as the master of ceremonies 202 has failed to beat the grand winner.

Then, at block 140, if the winner of the "SUPER" hand is the grand winner, the procedure 100 proceeds to block 142, if not, the procedure 100 proceeds to block 144.

At block 142, the grand winner is given the opportunity to exchange any of the prizes that have not been eliminated with a prize that has been eliminated, e.g. prizes highlighted in the prize section 302 of the display panel 300, for each medal in its possession. This is accomplished by removing/putting back the letter corresponding to the prize from/into the safe box 205. However, should none of the prizes be eliminated, the grand winner may select prizes to be excluded (e.g. the corresponding letter is taken out of the safe box 205), thus giving him/her better odds of winning one of the bigger prizes.

Finally, at block 144, the grand winner picks a letter from the safe box 205 and wins the prize associated with the picked letter.

Complimentary Gains

In an alternative embodiment, complimentary gains may be offered to the players 1, 2, 3, 4, 5, 6, 7, 8, 9 and 10. This is accomplished in conjunction with blocks 114 and 122 of procedure 100 (see FIG. 1) by assigning a prize or cash amount with each picked letter from the safe box 205. The prizes or cash amounts may be divided in seven value levels, the number of levels corresponding to the number of "super letters" (e.g. red letters), with each level having an increasing prize or cash amount assigned for blue and red letters.

When an eliminated player picks a letter at block 114, it is awarded the prize or cash amount assigned for the current level to the color of the picked letter (the prizes or cash amounts initially starting at the first level for the first eliminated player). If the color of the picked letter is blue, the procedure executes blocks 116 and 118, and then proceeds to block 120. However, if the color of the picked letter is red, the player is allowed to pick another letter and is further awarded the prize or cash amount assigned for the next level to the color of the picked letter. Blocks 116 and 118 are executed for each additional letter picked and this process continues until the player picks a blue letter. The next eliminated player is awarded prizes or cash amounts starting at the level of the last eliminated player.

In the case of the grand winner, it is awarded prizes or cash amounts as for the eliminated players but it may also be given the opportunity to pick extra letters in the event that a blue letter is picked. The grand winner may be allowed to do so a number of times equal to the number of medals in its possession, discarding one of the medals on each occasion.

Should a player complete the seventh level, it is then awarded a grand prize.

Figure 2:
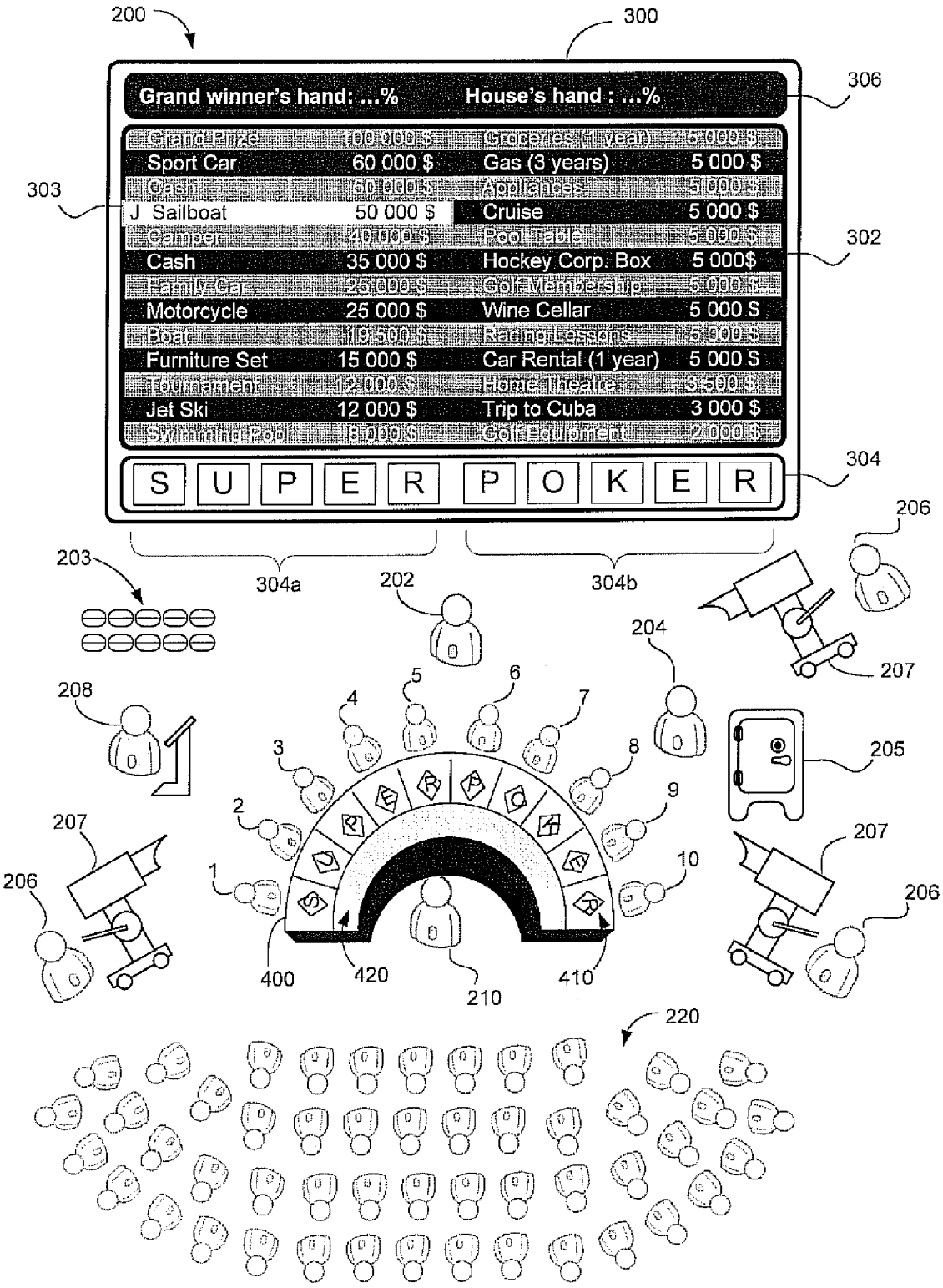
FIG. 2 is a schematic view of an illustrative example of a set for use in conjunction with the table game related broadcast show procedure of FIG. 1.
Figure 3:
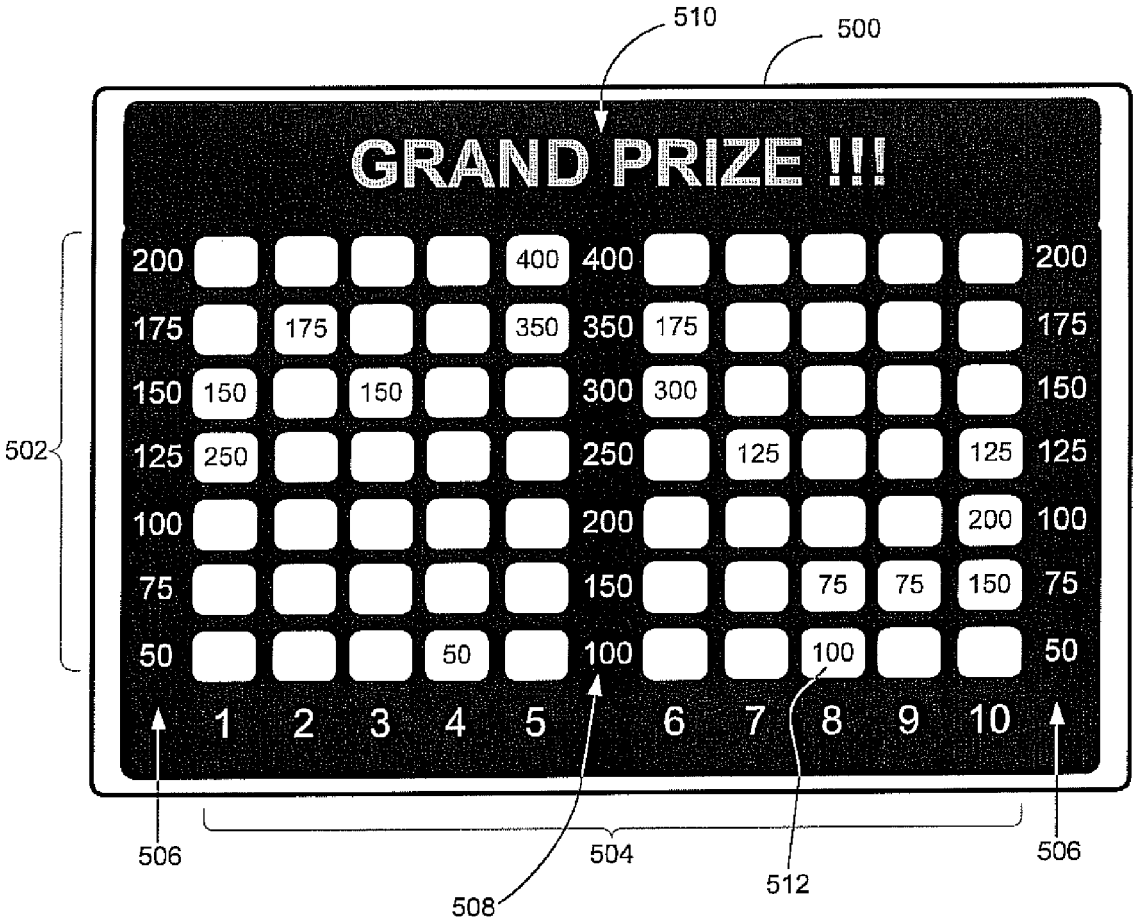
FIG. 3 is a schematic view of an illustrative example of a complimentary gains display for use in conjunction with the set of FIG. 2.

Referring to FIG. 3, there is shown an illustrative example of a complimentary gains display 500 for use in conjunction with the set 200 of FIG. 2. The complimentary gains display 500 includes seven levels 502, player indicators 504, a blue letter prize or cash amount 506 and a red letter prize or cash amount 508 assigned to each level 502, a grand prize indicator 510 and individual prize or cash amount displays associated with each player indicator 504 for each level 502.

EXAMPLE

In the illustrated example of FIG. 3, the following sequence of events is represented:

- player 4 was eliminated and picked a blue letter, winning $50;
- player 8 was eliminated, picked a red letter, winning $100, proceeded to the second level and then picked a blue letter, winning and additional $75;
- player 9 was eliminated, picked a blue letter, winning $75;
- player 10 was eliminated, picked a red letter, winning $150, proceeded to the third level, picked another red letter, winning an additional $200, proceeded to the fourth level and then picked a blue letter, winning and additional $125;
- player 7 was eliminated, picked a blue letter, winning $125;
- player 1 was eliminated, picked a red letter, winning $250, proceeded to the fifth level and then picked a blue letter, winning and additional $150;
- player 3 was eliminated, picked a blue letter, winning $150;

player 6 was eliminated, picked a red letter, winning $300, proceeded to the sixth level and then picked a blue letter, winning and additional $175;

player 2 was eliminated, picked a blue letter, winning $175; and player 10, the grand winner, picked a red letter, winning $350, proceeded to the seventh level, picked another red letter, winning an additional $400 and, having completed the seventh level, the grand prize 510.

In another alternative embodiment, the grand winner may be allowed to exchange one of the medals in its possession for a chance to pick an extra letter in the case where a blue letter is picked, thus giving the grand winner better probabilities of winning the grand prize. This may be repeated a number of times equals to the number of medals in the possession of the grand winner.

In a further alternative embodiment, if none of the eliminated players have completed the seventh level, the grand prize may be automatically awarded to the grand winner.

It is to be understood that the display panel 300 and the complimentary gain display may be mechanical or electronic (e.g. with LEDs, one or more video screens, etc.)

Lottery

A lottery may also be associated with the table game related broadcast show. This creates as sense of belonging for the audience playing the lottery as well as heightening the suspense during a game and thus encourages viewers to watch the table game related broadcast show until the end.

Figure 4:
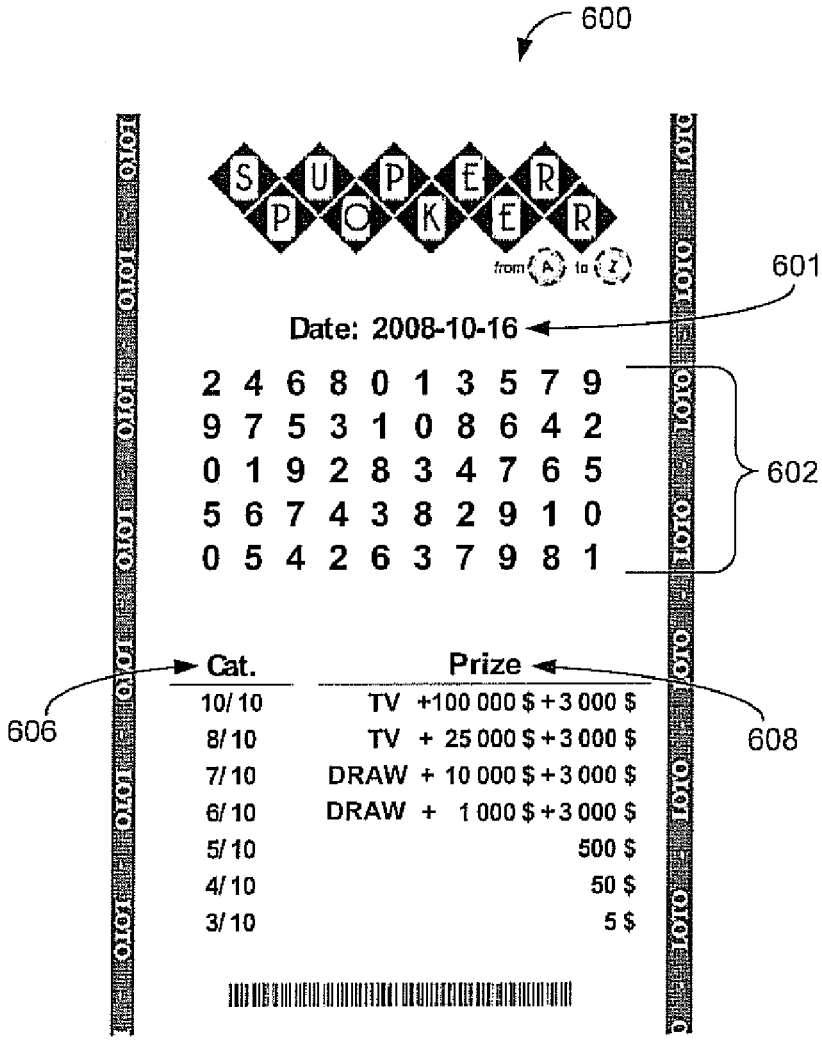
FIG. 4 is an illustrative example of a lottery ticket that may be used in associations with the table game related broadcast show.

Referring to FIG. 4, there is shown an illustrative embodiment of a lottery ticket 600 to be used with the lottery, the lottery ticket 600 having a broadcasting date 601, one or more series of digits or symbols 602, a column of winner categories 606 with a corresponding list of prizes 608.

In the illustrative embodiment, the number of digits or symbols 602 is equal to the number of players playing in the table game related broadcast show. For the sake of clarity and conciseness it will be assumed that the number of players in the table game related broadcast show is 10, as per the previous description of procedure 100 of FIGS. 1*a*, 1*b* and 1*c*. However, it is to be understood that if a different number of players is used in the table game related broadcast show, the number of digits or symbols 602 on the lottery ticket 600 would be in the same number as the number of players. Furthermore, it will also be assumed that the digits 0 to 9 are used, each digit representing a player in the table game related broadcast show with digit 0 representing player 10.

As the players 1, 2, 3, 4, 5, 6, 7, 8, 9 and 10 are eliminated during the course of the table game related broadcast show, a unique sequence of digits is created, to which corresponds the series of digits or symbols 602. Since each series of digits or symbols 602 comprises 10 unique digits, there exist 10! unique series of such digits, e.g. 3,628,000. Each lottery ticket 600 may comprise, for example, five unique series of digits for a total of 725,760 lottery tickets 600. Of course, other groupings of unique series may be used.

Assuming a cost of $1 per unique series of digits, e.g. $5 per lottery ticket 600, the total possible revenue is $3,628,000. Of this revenue, 50% may be, for example, distributed as prizes.

Of this 50%, prizes may be awarded to lottery ticket 600 holders having a given number of correct consecutive digits, as indicated by the winner categories 606 column. The prizes associated with each of the winner categories 606 are listed in the list of prizes 608 column. In the illustrative embodiment, the prizes listed in the list of prizes 608 include cash amounts, invitations to participate in the table game related broadcast show (identified as "TV") and invitations to participate in a draw to be invited to the table game related broadcast show (identified as "DRAW"). It is to be understood that the amounts may vary and that the invitations may be omitted or replaced. Furthermore, a number of drawing tickets may be provided to winning players as a function of the winner category they belong to.

For example, a lottery ticket 600 having 10 correct digits (e.g. 10/10 in the winner categories 606 column) will earn its owner an invitation to participate in the table game related broadcast show as well as a total of $103,000 (e.g. corresponding entry in the prizes 608 column). In another example, a lottery ticket 600 having 6 correct digits (e.g. 6/10 in the winner categories 606 column) will earn its owner an invitation to participate in a draw for an invitation to the table game related broadcast show as well as a total of $4,000 (e.g. corresponding entry in the prizes 508 column).

The remaining amount of the 50% of the revenues may be used toward providing prizes, for example cash amounts, during the next table game related broadcast show.

Figure 5:
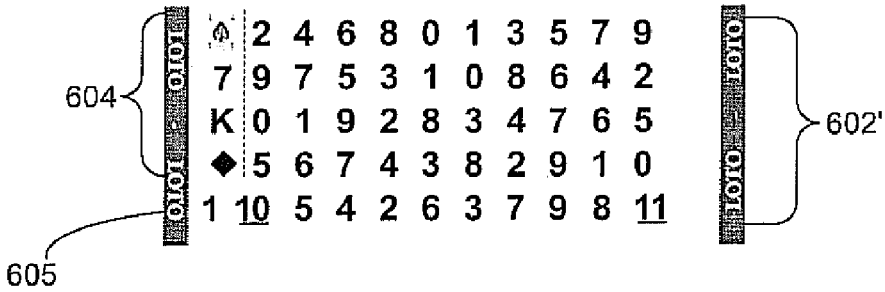
FIG. 5 is an illustrative example of an alternative series of digits or symbols for the lottery ticket of FIG. 4.

The number of available lottery tickets 600 may be increased in various ways by adding digits or symbols to the series of digits or symbols 602. Referring to FIG. 5, there is shown examples of series of digits or symbols 602' which may be used to increase the number of lottery tickets 600. For example, one or more extra symbol 604 such as a playing card, a digit, a letter, a suit, or any other symbol, may be added to each series of digits or symbols 602'. These extra symbols 604 may be selected, for example, randomly. The number of unique lottery tickets is then multiplied by 52, 10, 26 or 4 when adding, respectively, a playing card, a digit, a letter or a suit.

As discussed previously, another way to increase the number of available lottery tickets 600 is to increase the number of players in the table game related broadcast show. For example, if 11 players are used, then the series of digits or symbols 602' will comprise 11 numbers (in this case 1-11). This results in 11! unique series, e.g. 39,916,800.

The lottery ticket 600 may be purchased, for example, via a distribution service, lottery terminals, the internet, or any other appropriate means.

Furthermore, the lottery may be either local or global. By global it is meant that the lottery tickets 600 may be sold in various countries in which the table game related broadcast show is broadcasted. In order to do so, the number of available lottery tickets 600 may be increased as previously discussed and provide for even more interesting prizes.

It is to be understood that the amounts, prizes, ratios of distributed revenues discussed above are for illustrative purposes only and may vary.

Texas Hold'Em Poker Rules

The dealer 210 shuffles a standard 52-card deck. The dealer 210 never plays. A round disc—known as a "dealer button"—moves clockwise from player to player with each hand. The button marks which player 1-10 would be the dealer if the deal were advanced from player to player as the game went along.

Usually, the game starts with the two players 1, 2 to the left of the dealer 210 (the button) putting a predetermined amount of money into the pot before any cards are dealt, ensuring that there's something to play for on every hand.

This is called "posting the blinds." Most often, the "first blind"—the player 1 to the left of the dealer 210—puts up half the minimum bet, and the "second blind" puts up the full minimum bet.

Each player 1-10 is dealt two cards, face down. These are known as the "hole cards."

Betting Begins

A round of betting takes place, beginning with the player to the left of the two who posted the blinds. Players 1-10 can call, raise, or fold when it's their turn to bet.

The Flop

After the first betting round, the dealer 210 discards the top card of the deck. This is called burning the card and is done to ensure that no one accidentally saw the top card, and to help prevent cheating.

The dealer 210 then flips the next three cards face up on the table 400. These cards are called the "flop."

NOTE: Eventually, a total of five community cards will be placed face up on the table. Players 1-10 can use any combination of the community cards and their own two hole cards to form the best possible five-card Poker hand.

After the flop, another round of betting takes place, beginning with the player to the left of the dealer 210 (the button). During this and all future rounds of betting, players 1-10 can check, call, raise, or fold when it's their turn to bet.

The Turn

The dealer 210 burns another card and plays one more face up onto the table 400. This, the fourth community card, is called the "turn" or "Fourth Street."

The player to the left of the dealer 210 (the button) begins the third round of betting.

The River

The dealer 210 burns another card before placing the final face-up card on the table 400. This card is called the "river" or "Fifth Street."

Final Betting and The Winner

Players 1-10 can now use any combination of seven cards—the five community cards and the two hole cards known only to them—to form the best possible five-card Poker hand.

The fourth and final round of betting starts with the player to the left of the dealer 210 (the button).

After the final betting round, all players who remain in the game reveal their hands. The player who made the initial bet or the player who made the last raise shows their hand first.

The player with the best hand wins.

Ranking of Poker Hands From Royal Flush to High Card

Royal Flush

This is the best possible hand in standard five-card Poker. Ace, King, Queen, Jack and 10, all of the same suit.

Straight Flush

Any five-card sequence in the same suit (e.g.: 8, 9, 10, Jack and Queen of clubs; or 2, 3, 4, 5 and 6 of diamonds).

Four of a Kind

All four cards of the same value (e.g.: 8, 8, 8, 8; or Queen, Queen, Queen, Queen).

Full House

Three of a kind combined with a pair (e.g.: 10, 10, 10 with 6, 6; or King, King, King with 5, 5).

Flush

Any five cards of the same suit, but not in sequence (e.g.: 4, 5, 7, 10 and King of spades).

Straight

Five cards in sequence, but not in the same suit (e.g.: 7 of clubs, 8 of clubs, 9 of diamonds, 10 of spades and Jack of diamonds).

Three of a Kind

Three cards of the same value (e.g.: 3, 3, 3; or Jack, Jack, Jack).

Two Pair

Two separate pairs (e.g.: 2, 2, Queen, Queen).

Pair

Two cards of the same value (e.g.: 7, 7).

High Card

If a Poker hand contains none of the above combinations, it's valued by the highest card in it.

Simplified Poker-Related Card Game Rules

In yet another alternative embodiment, simplified poker-related card game rules may be used at block 110 of procedure 100 (see FIGS. 1*a*, 1*b* and 1*c*) in order to simplify and expedite the table game related broadcast show in order to, for example, respect broadcast time constraints.

The simplified poker-related card game rules are generally based on the Texas Hold'Em poker rules, the player positioned at the left of the table being assigned the "button", while the second and third players are assigned the "first blind" and "second blind", respectively.

Each player starts the game with a given number of chips representing "lives", for example three. During a hand, each player is dealt two cards, face down, after which, the player decides to either stay in or folds; there is no betting of arbitrary number of chips or raise.

The hidden cards are then turned and the winning probabilities of each hand, whether the player stayed in or folded, are displayed using, for example, the display panel 300. The "flop" is then revealed and the players who are still in decide whether or no to stay in or fold and the winning probabilities are updated. The same process is repeated for the "turn" and the "river".

At the end of the hand, the loosing players each loose a "life" (i.e. a chip). Furthermore, if one of the folding playing has a hand that beats the winning hand, that player also looses a life. This is to encourage players to takes chances and not be overly defensive, especially amateur players or people with no experience playing poker.

A player is eliminated when it looses all of its "lives". The medal of the eliminated player is then handed over to the winning player. In the case where there is more than one winning player, i.e. a tie, the medal of the eliminated player is simply removed from play.

It should be noted that at least two players should remain at the end of each hand. This may be ensured by forcing the last two betting players to stay in if all the other players have folded.

Although the present invention has been described by way of particular embodiments and examples thereof, it should be understood that it will be apparent to persons skilled in the art that modifications may be applied to the present particular embodiments without departing from the scope of the present invention. For example, although the Texas Hold'Em Poker rules have been used in the description of the table game related broadcast show, it is to be understood that other rules may be used as well. Furthermore, it is to be understood that reference to colors, e.g. red and blue, may be substituted for other colors.

What is claimed is:

1. A method for providing a poker-related game broadcast show, comprising:

a) selecting players;

b) allowing each player to select a case containing therein a medal, each medal having thereon a letter, the medal letter being selected from the group consisting of the letters S, U, P, E, R, O, K of a first color, and of the letters P, E, R of a second color;

c) positioning the players at respective gaming surfaces according to an order associated with the medal letter;

d) playing hands of the poker-related game until at least one player is eliminated;

e) handing over the medal of the at least one eliminated player to a winning player;

f) allowing the at least one eliminated player to pick a chip with having a letter thereon from a container, the chip letter being selected from the group consisting of the letters S, U, P, E, R, O, K of the first color, and of the letters A, B, C, D, F, G, H, I, J, L, M, N, Q, T, V, W, X, Y, Z of a second color;

g) eliminating a prize corresponding to the letter associated with the chip picked at step f);

h) placing a card corresponding to the letter associated with the chip picked at step f) in a space corresponding to the medal letter of the eliminated player;

i) repeating steps f) to h) until only one player remains, the remaining player being designated as the grand winner;

j) carrying out steps f) to h) for the grand winner;

k) optionally playing an extra poker-related game based on the cards corresponding to the P, O, K, E, R spaces from step h), the winning of which allowing the bringing back of an eliminated prize;

l) optionally playing an extra poker-related game based on the cards corresponding to the S, U, P, E, R spaces from step h), the winning of which allowing the exchange of eliminated prizes with non-eliminated prizes; and m) allowing the grand winner to pick a chip from the container, winning a prize corresponding to the letter associated with the chip picked.

2. A method according to claim 1, wherein the players are selected randomly.

3. A method according to claim 1, wherein the players are selected randomly from an audience.

4. A method according to claim 1, wherein the players are selected from a group consisting of celebrities, reality TV contestants, poker tournament winners and lottery winners.

5. A method according to claim 1, wherein the poker-related game follow the Texas Hold'Em rules.

6. A method according to claim 1, wherein the poker-related game is a simplified poker-related card game based on Texas Hold'Em rules.

7. A method according to claim 6, wherein each player is assigned a number of life chips and wherein loosing players loose a life chip as well as players having folded but holding a winning hand.

8. A method according to claim 1, further comprising offering complimentary gains to the players based on the order of their elimination and the color of the selected chip letter at step f).

9. A method of conducting a poker-related game broadcast show based lottery, comprising:

a) providing lottery tickets having thereon at least one series of symbols, each symbol being associated with a player of the poker-related game related broadcast show;

b) conducting the poker-related game broadcast show in accordance with claim 1;

c) producing a winning series of symbols from the order in which the players are eliminated during the table game related broadcast show and the grand winner; and d) attributing prizes to the lottery tickets in accordance with a number of correct symbols in the at least one series of symbols thereon.

10. A method for providing a poker-related game broadcast show, comprising:

a) selecting players;

b) providing each player with a medal indicative of a gaming position order;

c) positioning the players at respective gaming surfaces according to the order associated with the medal provided at step b);

d) playing hands of the poker-related game until at least one player is eliminated;

e) handing over the medal of the at least one eliminated player to a winning player;

f) eliminating prizes in accordance with random selections made by the eliminated at least one eliminated player;

g) repeating steps e) and f) until only one player remains, the remaining player being identified as the grand winner;

h) allowing the grand winner to bring back into play an eliminated prize for each medal possessed by the grand winner; and i) allowing the grand winner to randomly select a prize.

11. A method according to claim 10, wherein the poker-related game follow the Texas Hold'Em rules.

12. A method according to claim 10, wherein the poker-related game is a simplified poker-related card game based on Texas Hold'Em rules.

13. A method according to claim 10, further comprising offering complimentary gains to the players based on the order of their elimination and their random selections made at step f).

14. A method of conducting a poker-related game broadcast show based lottery, comprising:

a) providing lottery tickets having thereon at least one series of symbols, each symbol being associated with a player of the table game related broadcast show;

b) conducting the poker-related game broadcast show in accordance with claim 10;

c) producing a winning series of symbols from the order in which the players are eliminated during the table game related broadcast show and the grand winner; and d) attributing prizes to the lottery tickets in accordance with a number of correct symbols in the at least one series of symbols thereon.

15. A method of conducting a table game broadcast show based lottery, comprising:

a) providing lottery tickets having thereon at least one series of symbols, each symbol of the at least one series of symbols being associated with a player of the table game broadcast show;

b) conducting the table game broadcast show in accordance with claim 10;

c) producing a winning series of symbols from the order in which the players are eliminated during the table game broadcast show and the winner of the table game broadcast show; and d) attributing prizes to the lottery tickets in accordance with a number of correct symbols in the at least one series of symbols thereon.

16. A method according to claim 12, wherein each player is assigned a number of life chips and wherein loosing players loose a life chip as well as players having folded but holding a winning hand.

17. A method of conducting a table game broadcast show based lottery in accordance with claim 15, wherein the table game is a poker related game.

18. A method of conducting a table game broadcast show based lottery in accordance with claim 15, wherein the lottery tickets include a broadcasting date for the table game broadcast show.

19. A method of conducting a table game broadcast show based lottery in accordance with claim 15, wherein the lottery tickets include winner categories with corresponding prizes.

20. A method of conducting a table game broadcast show based lottery in accordance with claim 17, wherein the poker related game is Texas Hold'Em.

21. A method of conducting a table game broadcast show based lottery in accordance with claim 19, wherein the prizes include an invitation to participate in the table game broadcast show.

22. A method of conducting a table game broadcast show based lottery in accordance with claim 19, wherein the prizes include an invitation to participate in a draw to be invited to the table game broadcast show.

* * * * *